United States Patent [19]

Logie

[11] Patent Number: 4,932,329

[45] Date of Patent: Jun. 12, 1990

[54] SIMULATED HAND GRENADE WITH MARKING MEANS

[76] Inventor: Glenn S. Logie, 736 Ladybrook Crescent, London, Ontario, Canada N6J 2C6

[21] Appl. No.: 392,416

[22] Filed: Aug. 11, 1989

[51] Int. Cl.[5] ..... F42B 8/14

[52] U.S. Cl. ..... 102/498; 102/482; 102/502; 102/513; 273/418; 273/DIG. 2

[58] Field of Search ..... 102/395, 445, 482, 498, 102/502, 513, 529; 273/418, 428, DIG. 2

[56] References Cited

U.S. PATENT DOCUMENTS

| | | | |
|---|---|---|---|
| 2,960,934 | 11/1960 | Jackson et al. | 102/498 |
| 3,137,852 | 6/1964 | Hopper | 273/380 |
| 3,194,161 | 7/1965 | Becker et al. | 102/498 |
| 3,369,486 | 2/1968 | Wrennstad et al. | 102/498 |
| 3,419,274 | 12/1968 | Tabor | 273/418 |
| 3,472,218 | 10/1969 | Mars | 273/DIG. 2 |
| 3,492,945 | 2/1970 | Filippi | 102/498 |
| 3,630,186 | 12/1971 | Babyn | 273/DIG. 2 |
| 4,392,432 | 7/1983 | Fenrick et al. | 102/502 |

FOREIGN PATENT DOCUMENTS

| | | | |
|---|---|---|---|
| 587310 | 11/1959 | Canada | 102/482 |

*Primary Examiner*—Harold J. Tudor

*Attorney, Agent, or Firm*—R. Craig Armstrong

[57] ABSTRACT

A simulated hand grenade has a lightweight frangible outer shell of STYROFOAM (trademark), a small charge within the shell, fuse means for delayed detonation of the charge, and ignition means for activating the fuse means. In the preferred embodiment, there is a dye such as tempera powder within the shell. The fuse means is a lacquered igniter wire, commonly sold to hobbyists as "cannon fusing", which burns to provide a delayed detonation of in the range of two to ten seconds after ignition. The ignition means has a spring-loaded hammer arranged to impact a cap when released, to thereby explode the cap. The cap is positioned immediately adjacent to the end of an igniter wire such that igniter the wire is ignited by the explosion of the cap. The spring-loaded hammer is held against release by an overlying spoon pivotally installed on the top of the simulated grenade and secured against accidental release by a pin. The charge is in a cardboard cylinder within the shell, containing a charge of approximately 40 grains of FFFF black powder.

4 Claims, 1 Drawing Sheet

SIMULATED HAND GRENADE WITH MARKING MEANS

BACKGROUND OF THE INVENTION

This invention relates to a simulated hand grenade, for use in military training, police tactical training, and survival games, for example.

There is a need to simulate a grenade in a manner which is relatively realistic, and which preferably will leave an indication of "hits". With respect to the marking feature, it is known to use various dyes in simulated weapons such as those which fire marking ball projectiles, but there is no satisfactory marking grenade at present.

SUMMARY OF THE INVENTION

It is an object of the invention to provide a simulated hand grenade, which preferably produces marking of its target area.

Thus in accordance with the present invention there is provided a simulated hand grenade having a lightweight frangible outer shell (of STYROFOAM (trademark) foamed polystyrene, for example), a small charge within the shell, fuse means for delayed detonation of the charge, and ignition means for activating the fuse means.

In the preferred embodiment, there is a dye such as tempera powder within the shell. The fuse means is a lacquered igniter wire, commonly sold to hobbyists as "cannon fusing", which burns to provide a delayed detonation of in the range of two to ten seconds after ignition. The ignition means involves a spring-loaded hammer arranged to impact a cap when released, to thereby explode the cap. The cap is positioned immediately adjacent to the end of the igniter wire such that the igniter wire is ignited by the explosion of the cap. The spring-loaded hammer is held against release by an overlying spoon pivotally installed on the top of the simulated grenade and secured against accidental release by a pin.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
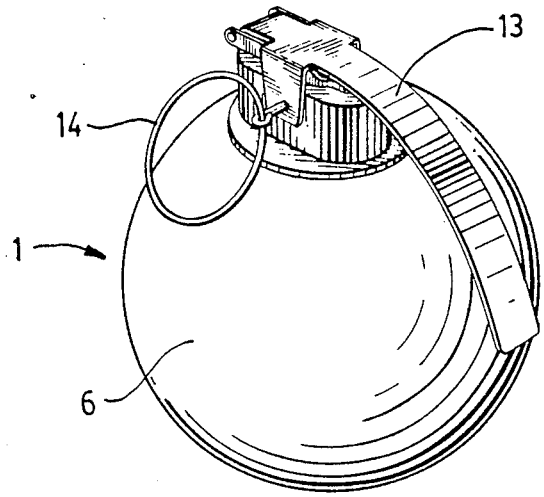
FIG. 1 is a perspective of the simulated grenade.
Figure 2:
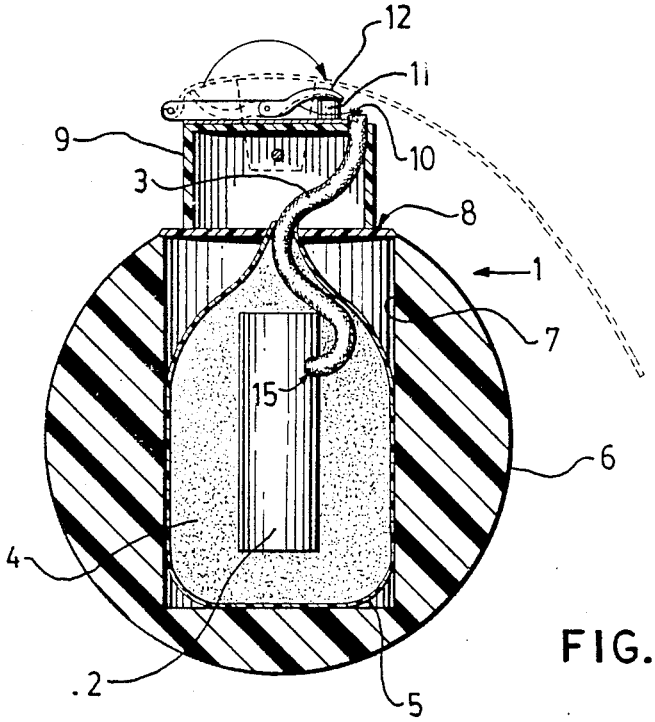
FIG. 2 is a cross-section of the simulated grenade.

The purpose of the simulated grenade 1 is to simulate with safety the effects of a fragmentation grenade (i.e., a hand-thrown bomb which when exploded breaks into projectiles, shrapnel, that fly in many directions). The device is in this case is made of STYROFOAM (trademark), cardboard, thin plastic wrap, aluminum and adhesive.

The heart of the device is a small explosive firecracker-like charge 2, detonated by a fuse 3. The charge is preferably surrounded by a mixture of brightly coloured non-toxic tempera powder 4, so that there is not only a simulated grenade detonation, but also marking of the target. This powder is placed around the charge

2 and sealed or bagged with plastic wrap 5 (e.g. SARAN WRAP (trademark)). The bagged charge and powder 4 assembly is inserted into a hollowed STYROFOAM foamed polystyrene ball 6.

The STYRROFOAM foamed polystyrene ball 6 has been hollowed or cored by removing a 35 mm diameter cylindrical section 7 from the centre of the ball. This section 7 is cut to a depth of 2-1/2", or approximately three-quarters of the depth of the STYROFOAM foamed polystyrene ball.

After the charge 2, powder 4, and bag 5 assembly have ben inserted, the ball is sealed with a cardboard cap 8. The detonation fuse 3 passes through a hole in the cap 8. The cap 8 is sealed in place a round its edges with any suitable adhesive, such as hot melt glue. The fuse 3 is passed up through a short piece of cardboard tube 9 and attached to the igniter 10. This tube is fastened to the ball 6 and cap 8 assembly, agan by means such as hot melt glue. The igniter 10 is fastened to the top of the cardboard tube 9, again by hot melt glue. This igniter 10 has a spring-loaded hammer 12 which strikes a primer cap 11 when released. The hammer 12 is held in firing position by a lever or "spoon" 13. The spoon is held in place with a pin 14 which passes through the spoon as well as the cardboard tube 9. The pin 14 will keep the device 1 from firing as long as it is in place. When the pin 14 is pulled, the device 1 will not ignite and detonate until the spoon 13 is released. When the spoon 13 is released, the hammer 12 throws the spoon 13 free, and flies to the firing position, with the hammer 12 striking the primer cap 11. The primer cap 11 ignites the fuse 3 which burns at the rate of approximately 1/2 inch per second, or 5 seconds for the length used in this case. The fuse material and length should be selected to provide a delay of at least about two seconds and preferable no more than about 10 seconds, or ideally from a realism viewpoint, about 5 seconds. The fuse preferably is a lacquered igniter wire, commonly sold to hobbyists as "cannon fusing", which burns to provide the delayed detonation. When the fuse 3 reaches the explosive charge 2, detonation occurs, causing the STYROFOAM foamed polystyrene ball 6 and contents 5 to rupture and fly in many directions, simulating a grenade blast. The upper tube 9, igniter 10 and cap 8 break off and fall away as one unit with very little velocity. The marking powder 4 and STYROFOAM foamed polystyrene shell 6 travel in many directions causing simultated shrapnel strikes up to ten metres away. The powder 4 is brightly coloured and dense, leaving marks which indicate hits from shrapnel. The colored powder 4 is non-toxic, water soluble and will break down in the environment. The powder 4 is non-flammable and absorbs sparks and embers created during ignition. The device 1 is safe enough to be used indoors as well, and prototypes have been safely detonated in the palm of a person's hand. Due to the light weight, the device 1 cannot be thrown violently or long distances. Most of the material this device 1 is made of is able to break down with exposure to elements. The device 1 can be checked to see if it is armed by looking for the bright red primer 11 cap, which is visible for quick inspection. These primer 11 caps can be removed for shipping.

The marking powder is, for example, water soluble non-toxic tempera art color powder, commonly used for children's art. Approximately 2-1/2 tablespoons are used in the preferred embodiment.

The primer cap 11 is a cap commonly used in children's cap guns, each cap containing less than 0.20 grains of active pyrotechnic substance. In the preferred embodiment, the caps are those made in Taiwan and sold under the BOOM BOOM trade mark by Colideal, P.O. Box 10, Ahunsic, Montreal H3L3N5, Quebec, Canada.

The charge 2 is a cardboard cylinder approximately 1-1/2 inches long by 5/16 inch internal diameter, sealed at each end with, for example, hot melt glue. In the cardboard cylinder is a charge of approximately 40 grains of FFFF black powder. This powder is very fast-burning, with minimal residue. It generates a lot of gas quickly, but very little heat, and is therefore excellent for this application. The fuse 3 is inserted into the powder through a small hole 15 in the cardboard cylinder.

It will be appreciated that the above description relates to the preferred embodiment by way of example. Many variations on the invention will be obvious to those knowledgeable in the field, and such obvious variations are within the scope of the invention as described and claimed, whether or not expressly described.

For example, the size and materials of the device could obviously be varied, as well as such things as the igniter.

Though the invention as implemented in the preferred embodiment is believed to be quite safe, the device of course should not be manufactured or marketed by anyone without adequate testing to ensure an adequate degree of safety and compliance with all relevant laws.

What is claimed is:

1. A simulated hand grenade comprising:

a lightweight frangible shell having an opening therein communicating with a hollowed-out central cavity within said shell;

a plastic bag within said central cavity;

a dye powder within said platic bag;

a small charge capsule within said dye powder;

fuse means comprising an igniter wire having one end in said charge capsule and a free end extending outwardly from said shell via said opening;

a cover across said opening, sealed with said shell, and having a hole through which said igniter wire passes, said hole being substantially sealed around said igniter wire;

ignition means connected to said shell, comprising a support platform and a spring-loaded hammer arranged to impact, when released from said spring loading, a cap placed on said support platform, to thereby explode said cap, said free end of said igniter wire being secured to said support platform immediately adjacent said cap, such that said igniter wire is ignited by the explosion of said cap, said spring-loaded hammer being held against release from said spring loading by an overlying spoon pivotally installed on said support platform and secured against accidental release by a pin passing through said spoon and said support platform.

2. A simulated hand grenade as recited in claim 1, in which said shell is of STYROFOAM (trademark) foamed polystyrene.

3. A simulated hand grenade as recited in claim 1, in which said dye is tempera powder.

4. A simulated hand grenade as recited in claim 1, in which said charge capsule comprises a cardboard cylinder sealed at each end and containing a charge of FFFF black powder, said igniter wire being inserted into the black powder through a small hole in said capsule.

* * * * *